US006766775B2

(12) United States Patent
Riedle et al.

(10) Patent No.: US 6,766,775 B2
(45) Date of Patent: Jul. 27, 2004

(54) METHOD AND SYSTEM FOR INCREASING THE ESTIMATION ACCURACY OF CAM PHASE ANGLE IN AN ENGINE WITH VARIABLE CAM TIMING

(75) Inventors: Bradley Dean Riedle, Northville, MI (US); Giuseppe Domenico Suffredini, Shelby Township, MI (US); Jeffrey Allen Doering, Canton, MI (US); Sean Wyatt, Detroit, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/682,930

(22) Filed: Nov. 1, 2001

(65) Prior Publication Data

US 2003/0079701 A1 May 1, 2003

(51) Int. Cl.[7] ..... F01L 1/34
(52) U.S. Cl. ..... 123/90.15; 74/568 R
(58) Field of Search ..... 123/90.15, 90.16, 123/90.17; 74/568 R; 464/1, 2, 160

(56) References Cited

U.S. PATENT DOCUMENTS 5,469,818 A * 11/1995 Yoshioka et al. ..... 123/90.15
5,548,995 A 8/1996 Clinton et al.
5,562,071 A * 10/1996 Urushihata et al. ..... 123/90.15
5,611,304 A * 3/1997 Shinojima ..... 123/90.15
5,626,109 A * 5/1997 Yasumura et al. ..... 123/90.15
5,678,515 A * 10/1997 Kato et al. ..... 123/90.15
5,738,053 A * 4/1998 Kato ..... 123/90.15
5,852,996 A 12/1998 Nakamura et al.
5,937,805 A * 8/1999 Matsumura ..... 123/90.15
5,992,383 A 11/1999 Scholten et al.
6,000,375 A * 12/1999 Isobe ..... 123/322
6,006,707 A * 12/1999 Ito ..... 123/90.15
6,006,725 A 12/1999 Stefanopoulou et al.
6,101,993 A 8/2000 Lewis et al.
6,161,511 A * 12/2000 Hashimoto ..... 123/90.15
6,499,449 B2 * 12/2002 Michelini et al. ..... 123/90.15
6,637,391 B2 * 10/2003 Muraki et al. ..... 123/90.17

* cited by examiner

*Primary Examiner*—Thomas Denion
*Assistant Examiner*—Jaime Corrigan
(74) *Attorney, Agent, or Firm*—Diana D. Brehob

(57) ABSTRACT

A system and method for determining an estimation of actual cam phase angle of increased accuracy are based on an observed cam phase angle derived from a cam phase sensor and a predicted cam phase angle derived from a desired or commanded cam phase angle. The estimated cam phase angle is used in the electronic control unit in computing desired settings for engine variables which depend on cam phase angle.

18 Claims, 7 Drawing Sheets

METHOD AND SYSTEM FOR INCREASING THE ESTIMATION ACCURACY OF CAM PHASE ANGLE IN AN ENGINE WITH VARIABLE CAM TIMING

BACKGROUND OF INVENTION

The present invention relates generally to an improved method for estimating the camshaft phase angle in an engine with variable cam timing.

The advent of variable cam timing in internal combustion engines has complicated the engine management task. Within the engine control unit, the electronic throttle valve position (alternatively, an idle bypass valve opening if not equipped with an electronically actuated throttle valve), fuel injection pulse width, spark timing, position of the exhaust gas recirculation valve, and the cam phase angle are engine variables commanded by the engine control unit to provide the power demanded by the operator of the vehicle while also delivering high fuel efficiency, low emissions, and acceptable drivability. These engine variables are strongly coupled and have a delay time constant associated with them. Thus, the task of changing among operating conditions in a smooth manner is enabled by the engine control unit containing models of the interdependencies among the variables, dynamic models of the various actuators, accurate information from sensors about the status of the various actuators.

The inventors of the present invention have recognized that the accuracy of prior art methods for predicting the actual cam phase angle can be improved. As a result, the coupled parameters, i.e., spark timing, throttle position, etc. listed above, may be computed inaccurately due to being based on inaccurate input cam phase angle data. One prior method relies on the output of a sensor on the cam phaser. Because the signal from the sensor is noisy, the signal is filtered, thereby reducing the bandwidth of the signal and thus, causing a delay. Another prior method relies on a model within the engine control unit and bases the prediction on the commanded phase angle and the dynamic characteristics of the cam phaser. The cam phaser may fail or may change dynamic characteristics over its lifetime causing the prediction to be in error.

SUMMARY OF INVENTION

The drawbacks of prior art approaches are overcome by a method for determining an estimated camshaft phase angle of increased accuracy by determining a desired camshaft phase angle, determining an observed raw camshaft phase angle, and basing the estimated camshaft phase angle on the desired camshaft phase angle and the observed raw camshaft phase angle. The raw observed camshaft phase angle may be based on the output of a camshaft phase angle sensor located proximately to the camshaft.

A primary advantage of the invention disclosed herein is a prediction of cam angle of increased accuracy and with a lesser delay than prior art methods.

A further advantage of the present invention is that it provides an accurate prediction of cam phase angle even as the cam phaser performance changes due to wear, failure, ambient conditions, or other anomaly.

A further advantage of the present invention is that the prediction of the disclosed method provides a less noisy signal than prior art methods.

The above advantages and other advantages, objects, and features of the present invention will be readily apparent from the following detailed description of the preferred embodiments when taken in connection with the accompanying drawings.

BRIEF DESCRIPTION OF DRAWINGS

The advantages described herein will be more fully understood by reading an example of an embodiment in which the invention is used to advantage, referred to herein as the Detailed Description, with reference to the drawings wherein.

DETAILED DESCRIPTION

Figure 1:
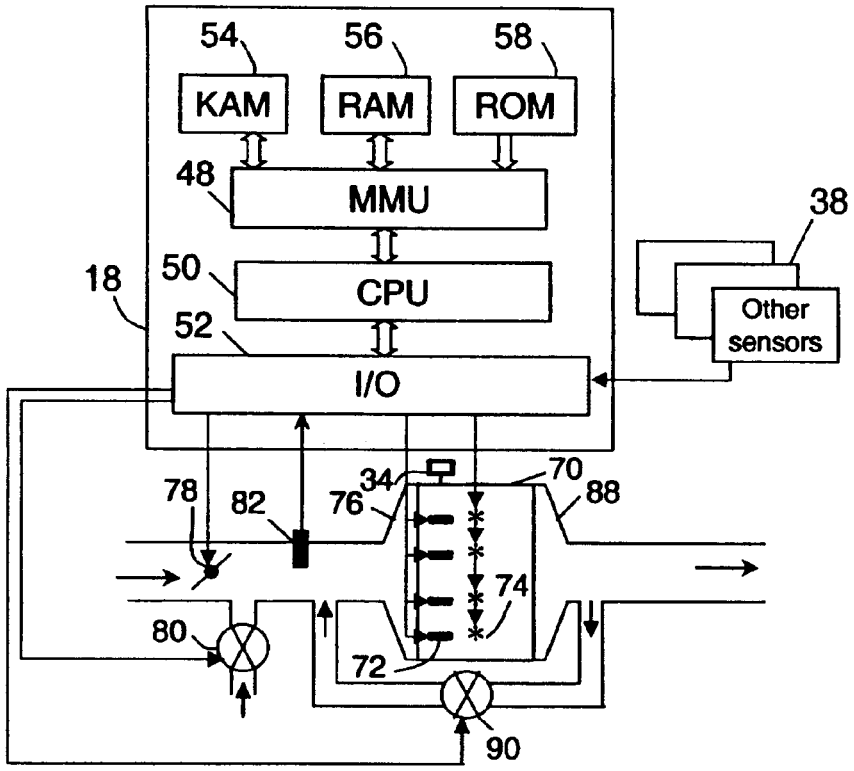
FIG. 1 is a schematic drawing of an engine indicating salient features for practicing invention.

An internal combustion engine 70 is shown in FIG. 1. Engine 70 shown is a spark-ignition engine with spark plugs 74 installed into engine 70. The invention may also apply to a compression-ignition engine which does not rely on spark plugs for ignition. Engine 70 is supplied fuel directly into the combustion chamber through injectors 72, as would be the case in a direct injection gasoline or diesel engine. Fuel injectors 72 could be situated, alternatively, near the intake ports to the combustion chamber. Engine 70 is provided with a cam phaser 34, which can alter the time at which the valves open and close relative to engine crankshaft rotation. A more detailed description is provided below with reference to FIG. 2. Engine 70 is supplied fresh air through an inlet duct containing a throttle valve 78. The engine discharges gases into an exhaust duct 88. A portion of the exhaust gas stream may be routed back to the intake duct through exhaust gas recirculation (EGR) valve 90.

Continuing with FIG. 1, engine control unit (ECU) 18 has a microprocessor 50, called a central processing unit (CPU), in communication with memory management unit (MMU) 60. MMU 60 controls the movement of data among the various computer readable storage media and communicates data to and from CPU 50. The computer readable storage media preferably include volatile and nonvolatile storage in read-only memory (ROM) 58, random-access memory (RAM) 56, and keep-alive memory (KAM) 54, for example. KAM 54 may be used to store various operating variables while CPU 50 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory capable of storing data, some of which represent executable instructions, used by CPU 50 in controlling the engine or vehicle into which the engine is mounted. The computer-readable storage media may also include floppy disks, CD-ROMs, hard disks, and the like. CPU 50 communicates with various sensors and actuators via an input/output (I/O) interface 52. Examples of items that are actuated under control of CPU 50 through I/O interface 52, are fuel injection timing, fuel injection rate, fuel injection duration, EGR valve 90 position, throttle valve 78 position, and cam phaser 34 position. Sensors communicating input through I/O interface 52 may be indicating engine speed, vehicle speed, coolant temperature, manifold pressure, pedal position, camshaft phase sensor 36, throttle valve 78 position, EGR valve 90 position, air temperature, exhaust temperature, mass air flow 82, and others; some of which are shown explicitly in FIG. 1 and others are shown as other sensors 38. Some ECU 18 architectures do not contain MMU 60. If no MMU 60 is employed, CPU 50 manages data and connects directly to ROM 58, RAM 56, and KAM 54. Of course, the present invention could utilize more than one CPU 50 to provide engine/vehicle control and ECU 18 may contain multiple ROM 58, RAM 56, and KAM 54 coupled to MMU 60 or CPU 50 depending upon the particular application.

An electronically-controlled throttle, such as throttle valve 78 shown in FIG. 1, provides an example of a system delay. When ECU 18 receives a signal from a pedal position sensor indicating a driver demand for additional power, ECU 18 commands throttle valve 78 to open. The additional power to the driving wheels is delayed by: ECU 18 in interpreting the signal (due to filtering) from the pedal position as a demand for power, computational delays in ECU 18 due to computational traffic, the limitations imposed by the time step at which computations are performed within ECU 18, mechanical delay in throttle valve 78 attaining the commanded position, and inertial delay in filling the intake manifold to the new, higher manifold pressure. It is known to those skilled in the art to model the air delivered to the engine accounting for system delays. The model relies on accurate information of many system variables, including valve timing, which is related to camshaft phasing. The ability of the model to provide the desired functionality depends on the accuracy of the models in capturing the phenomena and their interactions. The subject of the present invention is increasing the accuracy of cam phase angle data within the ECU 18.

Figure 2:
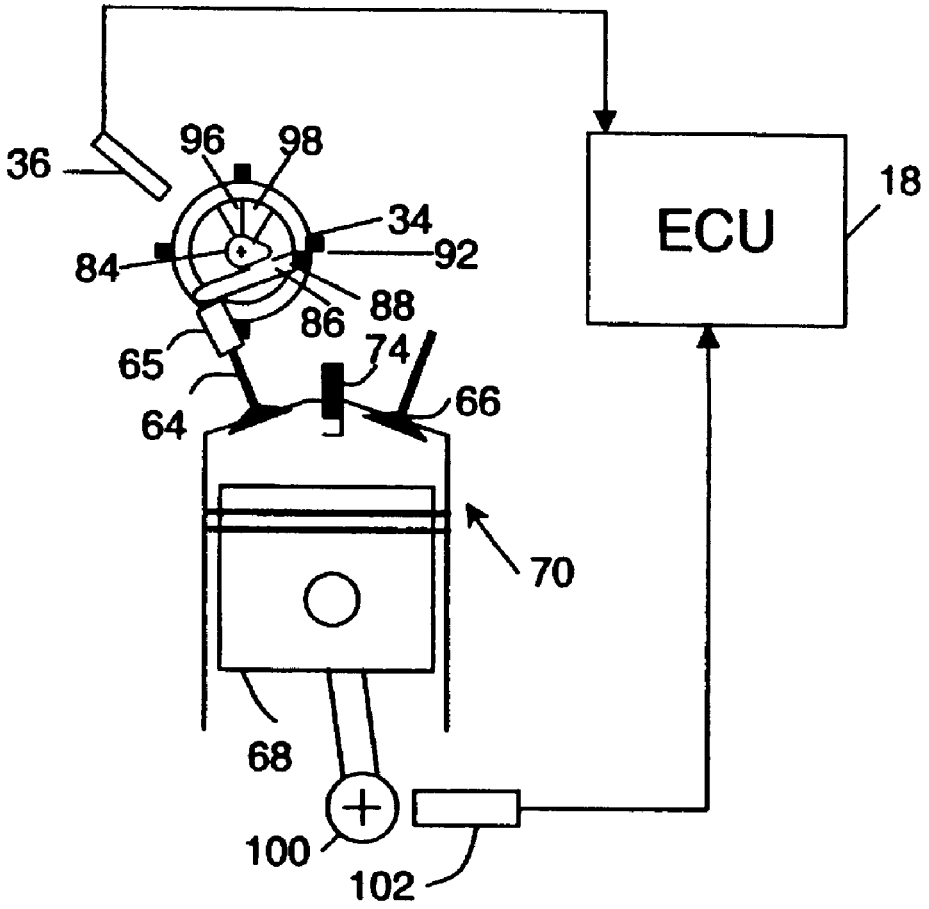
FIG. 2 is a schematic drawing of a single cylinder of an engine showing the camshaft phasing mechanism.

FIG. 2 shows a single piston 68 disposed in engine 70. Camshaft 84 of engine 70 is shown in FIG. 2 communicating with rocker arm 86 which is fixed at end 88 for actuating intake valve 64. Exhaust valve 66 may be similarly equipped as intake valve 64 (cam phasing hardware not shown). Alternatively, camshaft 84 may be used to actuate both intake valve 64 and exhaust valve 66, in which case a phase change in camshaft 84 affects both intake valve 64 and exhaust valve 66 timings. Camshaft 84 is directly coupled to cam phaser 34. Cam phaser 34 forms a toothed wheel having a plurality of teeth 92. Camshaft 84 is hydraulically coupled to an inner camshaft (not shown), which is in turn directly linked to camshaft 84 via a timing chain (not shown). Therefore, cam phaser 34 and camshaft 84 rotate at a speed substantially equivalent to the inner camshaft. The inner camshaft rotates at a constant speed ratio to crankshaft 100. However, by manipulation of a hydraulic coupling (not shown), the relative phase of camshaft 84 to crankshaft 100 can be varied by applying a hydraulic pressure in advance chamber 96 or retard chamber 98. By allowing high pressure hydraulic fluid to enter advance chamber 96, intake valve 64 opens and closes at a time earlier relative to crankshaft 100. Similarly, by allowing high pressure hydraulic fluid to enter retard chamber 98, intake valve 64 opens and closes at a time later relative to crankshaft 100.

Teeth 92, being coupled to cam phaser 34 and camshaft 84, allow for measurement of cam phase angle via cam timing sensor 92 providing a signal to ECU 18. Four equally spaced teeth on cam phaser 34 are preferably used for measurement of cam timing for a bank of four cylinders, eg., an inline four cylinder engine or one bank of a V-8 engine. ECU 18 sends control signals to conventional solenoid valves (not shown) to control the flow of hydraulic fluid either into advance chamber 96, retard chamber 98, or neither.

Camshaft phase angle may be measured using the method described in U.S. Pat. No. 5,548,995, which is incorporated herein by reference. In general terms, the rotation angle between the rising edge of a signal from sensor 102 which senses a tooth (not shown) coupled to crankshaft 100 and a signal detected by camshaft phase sensor 36 from one of the plurality of teeth 92 on cam phaser 34 provides a measure of the relative cam timing. For the particular example of an inline four cylinder engine, with a four-toothed wheel on cam phaser 36, a measure of cam timing for each bank is received four times per revolution.

Figure 3:
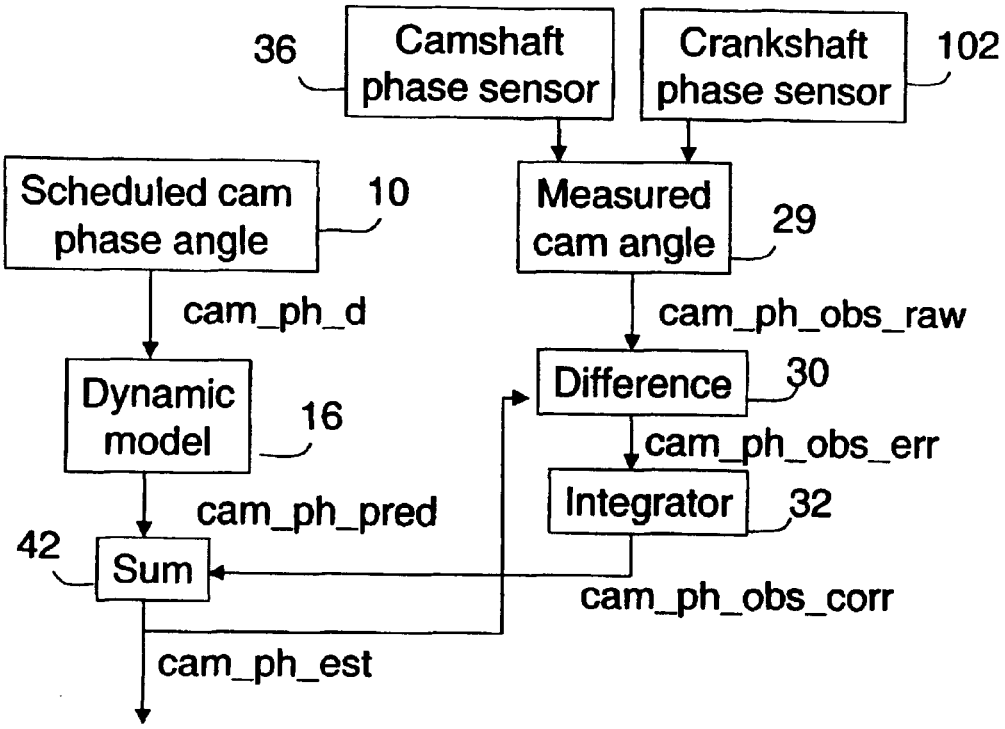
FIG. 3 is a flowchart of the steps involved according to an aspect of the present invention.

Referring now to FIG. 3, ECU 18 schedules cam phaser 34, in block 10, according to models within ECU 18, one example of which is described in U.S. Pat. No. 6,006,725, which is incorporated herein by reference. This provides the desired phase of the camshaft, which is denoted as cam_ph_d herein. Within ECU 18 is a dynamic model 16 of cam phaser 34. The dynamic model 16 may incorporate system inertias, compliances, compressibilities, actuator delays, material characteristics, and other factors to describe the behavior of camshaft 84 in response to a command to cam phaser 34 to make an angle change. Based on dynamic model 16, a predicted cam phase can be computed, denoted as cam_ph_pred. In block 42, cam_ph_pred and cam_ph_obs_corr are summed to yield cam_ph_est, which is the estimated cam phase angle with increased accuracy compared to prior art methods. The observer leg of the computation begins with a measurement of the cam phase angle, cam_ph_obs_raw, which is computed in block 29 based on signals from the camshaft phase sensor 34 and the crankshaft phase sensor 102. In block 30, the raw signal (cam_ph_obs_raw) is compared with cam_ph_est. An error signal, cam_ph_obs_err is the output of block 30. In block 32, cam_ph_obs_err is integrated, which filters the signal and provides a corrected signal, called cam_ph_obs_corr herein. As discussed above, cam_ph_obs_corr is used in block 42 as one of the inputs to provide the output, cam_ph_est.

Figure 4:
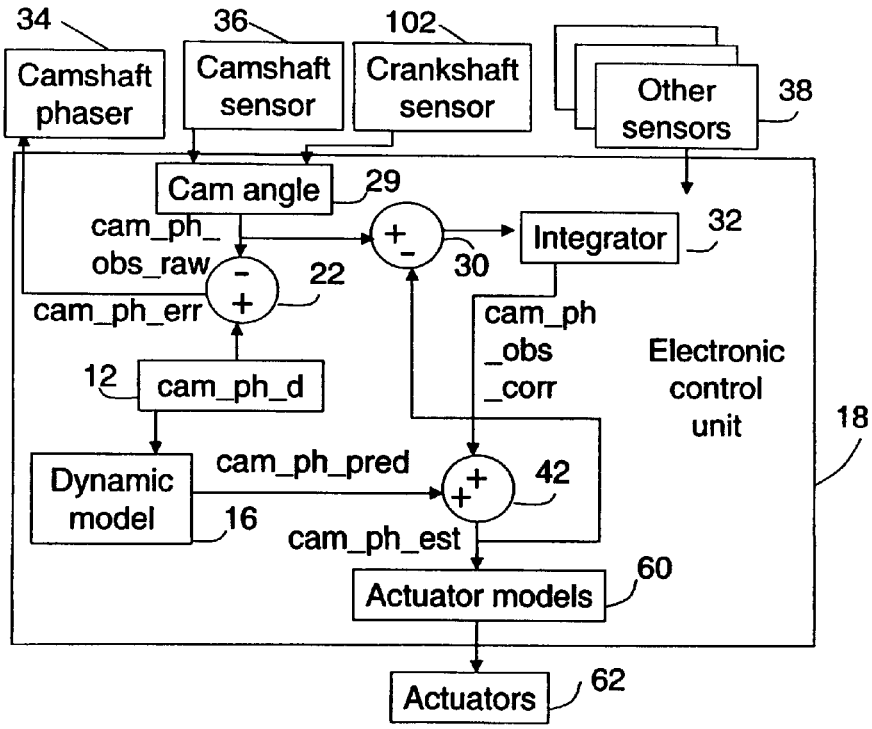
FIG. 4 is schematic drawing of the calculation steps in the engine control unit according to an aspect of the present invention.

FIG. 3 is a simplified version of the invention to clearly indicate that two inputs are used to arrive at cam_ph_est. FIG. 4 shows the method in more detail and in context within ECU 18. ECU 18 receives input from sensors 38 and camshaft sensor 36 and crankshaft sensor 102; from the latter two sensors, ECU 18 computes cam_ph_obs_raw in block 29. ECU 18 computes cam_ph_d, the desired cam phase, based on a model such as taught in U.S. Pat. No. 6,006,725. Cam_ph_d and cam_ph_obs_raw are compared in operation 22, which provides the value of cam_ph_err, that is the difference between the commanded signal and the measured signal. Cam_ph_err is used as feedback control to camshaft phaser 34, as in prior art. Cam_ph_d, block 12, is used in dynamic model 16 to determine cam_ph_pred. Cam_ph_pred is summed in block 42 with the output of blocks 30 and 32, previously described in conjunction with FIG. 3. The output of summing operation 42 yields cam_ph_est, the subject of the present invention. Cam ph_est is used within ECU 18 in relevant actuator models. These may be models which compute desired throttle valve 78 position, desired EGR valve 90 position, spark timing, fuel injection timing, and fuel injection pulse width, as examples. Output of the actuator models 60 is fed to actuators 62.

Figure 5:
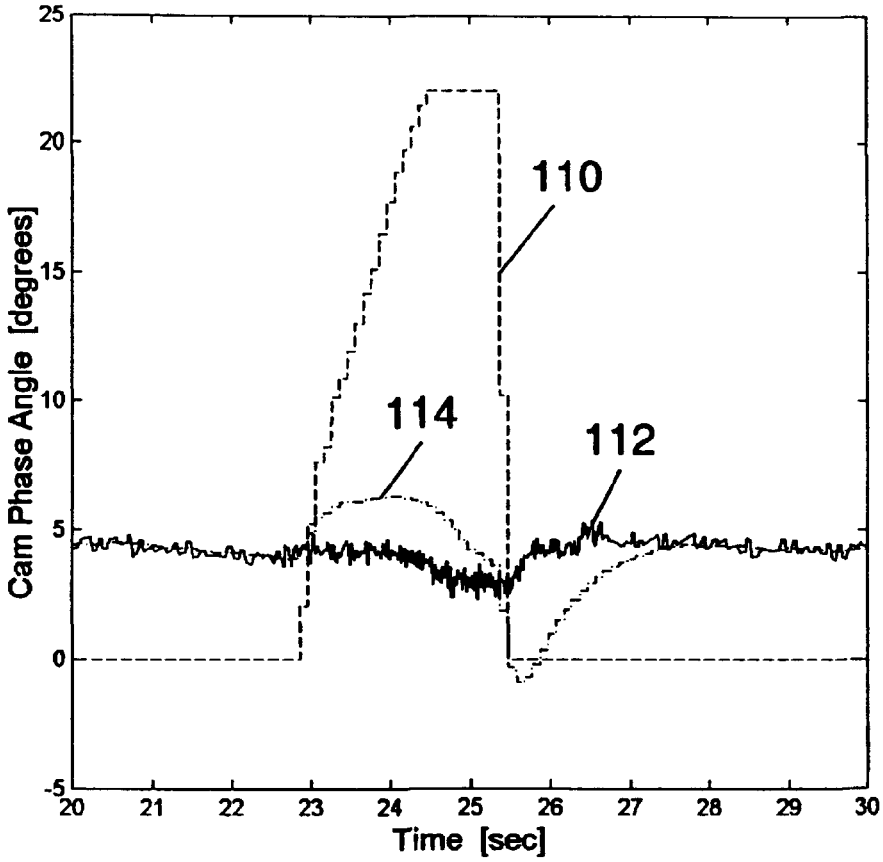
FIG. 5 is a plot of desired camshaft phase angle, raw observed camshaft phase angle, and estimated camshaft phase angle as functions of time for a disabled camshaft phaser.
Figure 6:
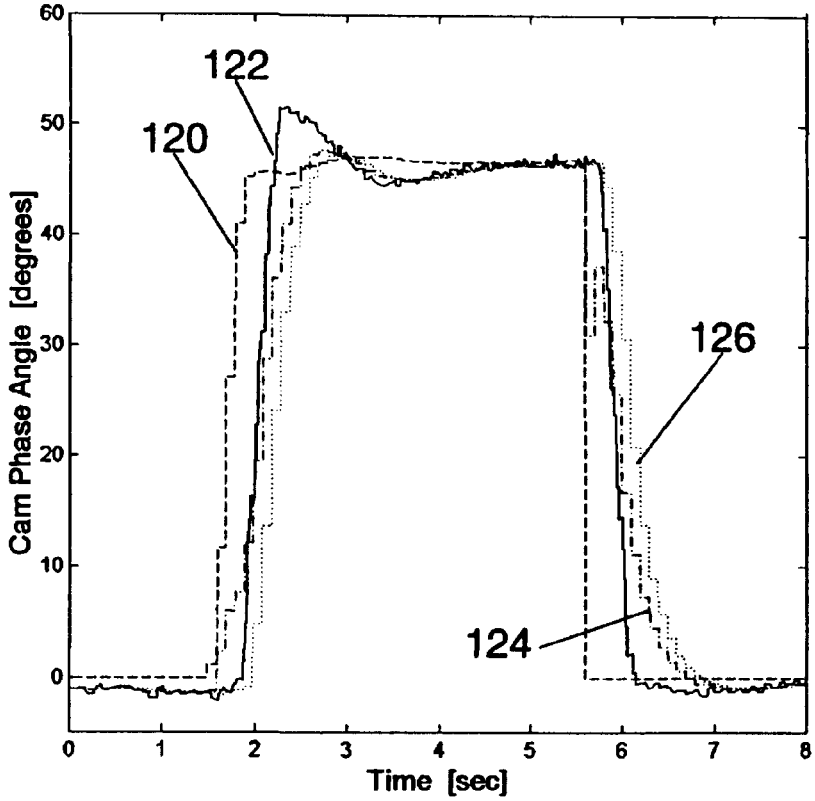
FIG. 6 is a plot of desired camshaft phase angle, raw observed camshaft phase angle, estimated camshaft phase angle, and filtered observed camshaft phase angle as functions of time for an operating camshaft phaser.
Figure 7:
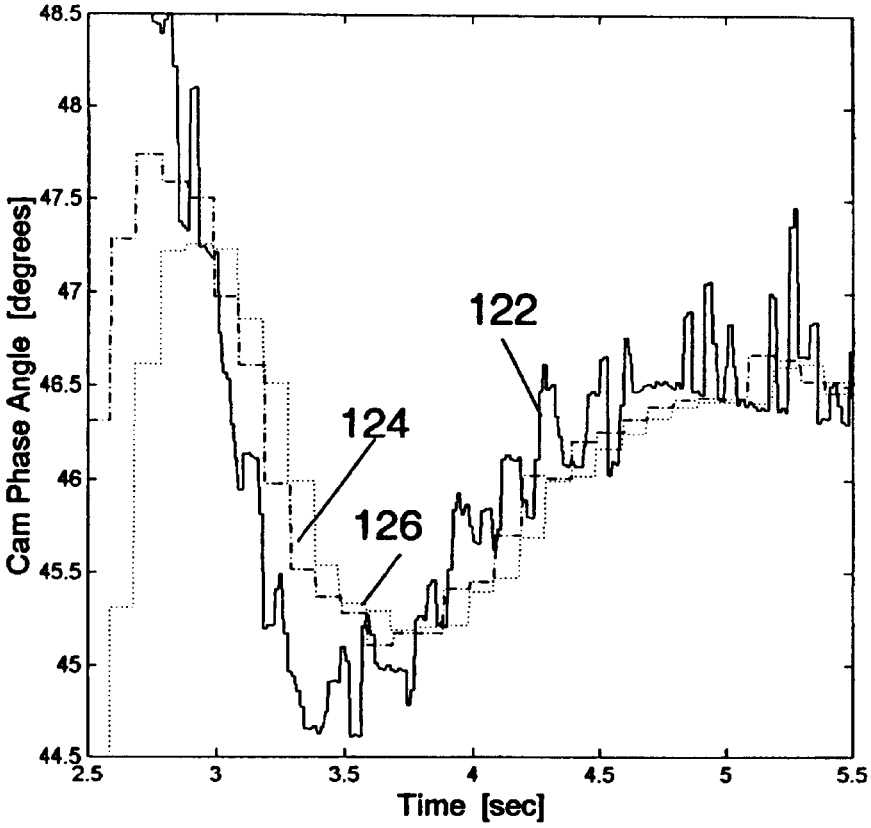
FIG. 7 displays a portion of FIG. 6 enlarged.

The present invention is demonstrated in FIGS. 5–7, in which experimental data are used to illustrate the present invention and compare it with prior art solutions. In FIG. 5, an inoperable camshaft phaser 34 is commanded a camshaft position, i.e., the desired camshaft phase angle, cam_ph_d, shown as curve 110. Because the camshaft phaser 34 is inoperable, the camshaft does not respond. Curve 112 is the cam_ph_obs_raw, i.e., the measured cam phase angle. Curve 112 does not deviate from the initial value since the camshaft phase does not change. Curve 112, however, does indicate a typical noise level on the signal. If cam_ph_obs_raw were used as the basis to compute other engine parameters, such as throttle position, these parameters would constantly vary. Eg., throttle plate 78 would flutter in response to the noise appearing on curve 112. The estimate of cam phase, as provided by the present invention cam_ph_est, shown in curve 114, is based on both cam_ph_obs_raw and cam_ph_d. As such, it does deviate from a steady value in response to the command to camshaft phaser 34. However, it readily returns to the steady value. Also, curve 114 is not a noisy signal.

In FIG. 6, a working camshaft phaser 34 is commanded to assume a new desired phase angle, cam_ph_d which is shown as curve 120. Curve 122 shows the output of the measurement, cam_ph_obs_raw. Again, there is noise on the measured signal, curve 122. Curve 124 shows the estimated camshaft phase angle, according to the present invention. Curve 126 shows a filtered version of curve 122. As mentioned above, a problem with cam_ph_obs_raw is that due to its noise, control of other engine parameters is degraded. A common technique to remove noise from a signal is to filter the signal with the undesired consequence that the signal is time delayed. Curve 126 is a filtered version of curve 122. It can be seen in FIG. 6 that curve 124, the subject of the present invention lags behind the unfiltered measured signal, curve 122, but precedes the filtered measured signal, curve 126. FIG. 7 is an enlarged version of a portion of FIG. 6. The noise of curve 122 is even more evident in FIG. 7. The stepwise nature of curve 124, cam_ph_est, is due to the computation time step, which is 100 msec. Similarly, the filtered version of the measured signal, curve 126, changes on a 100 ms time scale; thus similar to curve 122, curve 126 displays a stepwise character. Curve 126 lags curve 122 by about one computation step, or 100 msec. Thus, the present invention provides a clear advantage over filtering a measured signal.

While a preferred mode for carrying out the invention has been described in detail, those familiar with the art to which this invention relates will recognize alternative designs and embodiments for practicing the invention. The above-described embodiment is intended to be illustrative of the invention, which may be modified within the scope of the following claims.

What is claimed is:

1. A computer readable storage medium having stored data representing instructions executable by a computer to control an internal combustion engine and a camshaft phaser coupled to a camshaft of the engine, comprising:

instructions to determine a predicted camshaft phase angle based on the desired camshaft phase angle and a model of dynamic characteristics of the camshaft phaser; and instructions to compute an estimated camshaft phase angle based on an observed raw camshaft phase angle and said predicted camshaft phase angle.

2. The computer readable storage medium according to claim 1 wherein said observed raw camshaft phase angle is based on a signal from a camshaft phase angle sensor proximate to the camshaft phaser.

3. The computer readable storage medium according to claim 1 further comprising:

instructions to compute a desired position of a throttle valve disposed in an intake duct of the engine, said desired position being based on said estimated camshaft phase angle; and instructions to actuate said throttle valve to attain said desired position.

4. The computer readable storage medium according to claim 1 further comprising:

instructions to compute a desired state of an engine actuator coupled to the engine, said desired state being based on said estimated camshaft phase angle; and instructions to actuate said engine actuator to attain said desired state.

5. The computer readable storage medium according to claim 4 wherein said engine actuator may comprise a second camshaft phaser, a fuel injector, an exhaust gas recirculation valve, a throttle valve, or a spark plug.

6. The computer readable storage medium according to claim 1 wherein said medium comprises a computer chip.

7. A method for determining an estimated camshaft phase angle relative to a default phase angle, the method comprising the steps of:

determining a desired camshaft phase angle;

determining an observed raw camshaft phase angle;

determining the estimated camshaft phase angle based on said desired camshaft phase angle and said observed raw camshaft phase angle; and determining a predicted camshaft phase angle based on said desired camshaft phase angle and a model of dynamic characteristics of a camshaft phaser coupled to the camshaft, wherein said camshaft phaser causes the phase angle shift of the camshaft.

8. The method according to claim 7 comprising the further step of determining an observed camshaft phase angle error based on a difference of said observed raw camshaft phase angle and the estimated camshaft phase angle.

9. The method according to claim 8 comprising the further step of determining a corrected observed camshaft phase angle based on the integration of said observed camshaft phase angle error.

10. The method according to claim 7 wherein said observed raw camshaft phase angle is based on a signal from a camshaft phase angle sensor proximate to said camshaft.

11. The method of claim 7, further comprising the step of: determining the estimated camshaft phase angle based on the sum of said predicted camshaft phase angle and said corrected observed camshaft phase angle.

12. The method of claim 7, wherein the camshaft is coupled to an internal combustion engine.

13. The method according to claim 12 wherein a desired value of an engine parameter of said engine is based on said estimated camshaft phase angle.

14. The method according to claim 13 wherein said engine parameter may comprise a throttle valve position, an exhaust gas recirculation valve position, an idie air bypass valve position, a spark timing, a fuel pulse width, or a fuel injection timing.

15. A system for determining an estimated camshaft phase angle, comprising:

a camshaft;

a camshaft phaser coupled to said camshaft to shift phase angle of said camshaft relative to a default phase angle;

a camshaft phase angle sensor proximate to said camshaft which yields a signal based on said phase angle shift; and an electronic control unit operably connected to said camshaft phaser and said camshaft phase angle sensor, said electronic control unit actuates said camshaft phaser to achieve a desired camshaft phase angle and determines an estimated camshaft phase angle based on said desired camshaft phase angle and said camshaft phase angle sensor signal wherein said estimated camshaft phase angle is based on a sum of a predicted camshaft phase angle and a corrected observed camshaft phase angle.

16. The system according to claim 15 wherein said predicted camshaft phase angle is based on said desired camshaft phase angle and a model of dynamic characteristics of said camshaft, said model being disposed in said electronic control unit.

17. The system according to claim 16 wherein said corrected observed camshaft phase angle is based on integrating an observed camshaft phase angle error.

18. The system accozding to claim 17 wherein said camshaft phase angle error is based on a difference of said observed raw camshaft phase angle and the estimated camshaft phase angle.

* * * * *